US009068308B2

(12) United States Patent
Ito et al.

(10) Patent No.: US 9,068,308 B2
(45) Date of Patent: Jun. 30, 2015

(54) BEACH CLEANER

(75) Inventors: Shinji Ito, Wako (JP); Tatsuo Masuda, Wako (JP); Yasuji Hashimoto, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 287 days.

(21) Appl. No.: 13/883,307

(22) PCT Filed: Dec. 9, 2010

(86) PCT No.: PCT/JP2010/007170

§ 371 (c)(1),
(2), (4) Date: May 3, 2013

(87) PCT Pub. No.: WO2012/077167

PCT Pub. Date: Jun. 14, 2012

(65) Prior Publication Data

US 2013/0233579 A1 Sep. 12, 2013

(51) Int. Cl.
*A01B 43/00* (2006.01)
*E01H 12/00* (2006.01)

(52) U.S. Cl.
CPC ..... *E01H 12/002* (2013.01)

(58) Field of Classification Search
CPC ..... E01H 12/00; E01H 12/02; B07B 1/005; B07B 1/30; B07B 1/04; B07B 1/46; B07B 13/16
USPC ..... 37/268; 171/14, 45, 46, 112, 132–135, 171/143
See application file for complete search history.

(56) References Cited

U.S. PATENT DOCUMENTS

| | | | | |
|---|---|---|---|---|
| 6,899,185 | B2 * | 5/2005 | Yagisawa et al. | 171/143 |
| 8,109,342 | B2 * | 2/2012 | Asao et al. | 171/143 |
| 8,113,294 | B2 * | 2/2012 | Arai et al. | 171/111 |
| 8,720,594 | B2 * | 5/2014 | Sato et al. | 171/135 |
| 2002/0178623 | A1 | 12/2002 | Yagisawa et al. | |

FOREIGN PATENT DOCUMENTS

| | | | |
|---|---|---|---|
| JP | 2002-356827 | A | 12/2002 |
| WO | WO 2010/087183 | A1 | 8/2010 |

* cited by examiner

*Primary Examiner* — Robert Pezzuto
(74) *Attorney, Agent, or Firm* — Birch, Stewart, Kolasch & Birch, LLP

(57) ABSTRACT

A beach cleaner for recovering relatively heavy garbage or stones while minimizing the amount of sand entering a garbage recovery unit. The beach cleaner includes a frame formed by a longitudinal member and a lateral member. A towed portion is provided at the front portion of the frame for towing by a tow vehicle. A separator is provided at the lower front portion of the frame to separate and scrape garbage from sandy ground. A recovery unit is provided behind the separator to collect garbage scraped onto the mesh member. At least one separation rod unit is provided having a plurality of longitudinal members and a lateral member for joining the rear ends of the respective longitudinal members. The front end of at least one separation rod unit is secured to the separator so as to be turnable in the up-and-down direction.

16 Claims, 9 Drawing Sheets

BEACH CLEANER

TECHNICAL FIELD

The present invention relates to a beach cleaner for collecting various garbage scattering on a sand beach such as a swimming beach or the like.

BACKGROUND ART

Various garbage such as fragments of fishing nets, ropes, vinyl cords, paper waste, chips of wood, empty cans, bottles, plastic bottles, caps of the plastic bottles, cigarette ends, etc. scatters on a sand beach such as a swimming beach or the like. As a beach cleaner for collecting these garbage is known a beach cleaner in which a frame is formed by plural longitudinal members extending along a running direction and plural lateral members which extend in a width direction so as to intersect to the longitudinal members, ski members are disposed at four corner portions of the frame so as to come into contact with sands, a scraper is secured to the front portion of the frame, and a garbage collector obtained by securing a mesh member to a box-like frame opened to the front and upper sides is provided to the rear portion of the frame. The beach cleaner runs on the sands while pulled by a tractor with the scraper biting into the sands, whereby relatively small garbage or stones can be scraped up together with the sand and collected onto the mesh member (for example, see Patent Document 1).

PRIOR ART DOCUMENT

Patent Document

Patent Document 1: JP-A-2002-356827

SUMMARY OF THE INVENTION

Problem to be Solved by the Invention

Beach cleaners that scoop garbage and stones together with sand by using a separator to withdraw the garbage and the stones into a garbage recovery unit have a problem that the sand accumulates in the recovery unit and thus the recovery efficiency decreases when the amount of the sand entering the recovery unit together with the garbage and the stones is excessively large. Therefore, in order to reduce the amount of the sand entering the recovery unit, a gap is provided between the separator and the recovery unit so that the sand drops from the gap.

However, when the gap is provided between the separator and the recovery unit, there is also a problem that a certain degree of heavy garbage or stones such as large stones, plastic bottles containing liquid or the like also drop from the gap, and thus they cannot be recovered.

The present invention has been implemented in view of the foregoing situation, and has an object to provide a beach cleaner that can recover a certain degree of heavy, garbage or stones such as large stones, plastic bottles containing liquid or the like in spite of reduction of the amount of sand entering a garbage recovery unit.

Means of Solving the Problem

In order to attain the above object, a beach cleaner (1) having a frame (53) comprising a longitudinal member (51) and a lateral member (52), a towed portion (67) that is provided at a front portion of the frame (53) and configured to be towed by a tow vehicle (2), a separator (60) that is provided at a lower front portion of the frame (53) to separate and scrape garbage from sandy ground, and a recovery unit (50) that is provided to the frame (53) behind the separator (60) and collects the garbage scraped by the separator (60) onto a mesh member (116), is characterized by further comprising at least one separation rod unit (95) having longitudinal members (96) and a lateral member (97) for joining rear ends (96*b*) of the longitudinal members (96), the separation rod unit (95) being provided to be bridged between the separator (60) and the upper surface of the mesh member (116) of the recovery unit (50) so that a front end of the separation rod unit (95) is secured to the separator (60) so as to be turnable in an up-and-down direction.

The longitudinal members bounce heavy stones and garbage falling into the gap between the rod-shaped scraper and the longitudinal members out of garbage, stones and sand scraped by the rod-shaped scraper, and guide the heavy stones and garbage to the garbage recovery unit. In addition, the longitudinal members are vertically turned to stir the flow of the scraped sand to pulverize the lumps of the sand. The lateral member serves as a projection which is mounted on the front slope portion of the mesh member and traverses the front slope portion.

Accordingly, heavy stones and garbage such as large stones, plastic bottles containing liquid, etc. which drop into the gap between the rod-shaped scraper and the longitudinal member because they are heavy can be recovered in the garbage recovery unit. Furthermore, even when large lumps of sand are scraped by the rod-shaped scraper, the lumps of sand can be divided and pulverized by the longitudinal members, so that the working efficiency can be enhanced with keeping the amount of sand entering the recovery unit to a proper amount by the pulverization. Furthermore, garbage recovered in the garbage recovery unit can be prevented from flowing back and dropping due to vibration.

Openings (99) formed by the longitudinal members (96) and the lateral member (97) of the separation rod unit (95) may be larger than meshes of the mesh member (116) of the recovery unit (50).

Most of scraped sand can be screened through the openings of the separation rod unit. Therefore, the amount of sand entering the garbage recovery unit can be kept to a proper amount, and garbage and stones can be separated and recovered with preventing sand from being stocked on the mesh member The separator (60) may have support plates (54) provided at equal intervals in a lateral direction and a rod-shaped scraper (55) penetrating through the support plates (54), and front ends (96*a*) of the longitudinal members (96) of the separation rod unit (95) may be freely turnably secured to the rod-shaped scraper (55).

The flow of sand, stones and garbage scraped by the rod-like scraper is rectified by the longitudinal members, and the stones, sand and garbage scraped by the rod-like scraper smoothly enter the recovery unit along the longitudinal members, so that garbage and stones can be efficiently recovered.

At least one longitudinal member (96) of the separation rod unit (95) may be secured and arranged between adjacent support plates (54) so as to section the gap (41) between the adjacent support plates (54) at equal intervals.

Uneven garbage recovery and uneven pulverization of lumps of sand can be prevented.

A collar (298) having a predetermined length in an axial direction thereof may be provided to the front end (96*a*, 296*a*) of each of the longitudinal members (96, 296) of the separation rod member (95, 295) so that the rod-shaped scraper (55) penetrates through the collar (298), thereby securing the separation rod unit (95, 295) to the separator (60).

Even when force in the right-and-left direction is applied to some of the longitudinal members, the collar bites the rod-shaped scraper to regulate the lateral displacement of the separation rod unit. Accordingly, the interval between the support plate and the longitudinal member and the interval between the longitudinal members can be kept substantially equal to each other, so that uneven garbage recovery and uneven pulverization of lamps of sand can be more surely prevented.

The recovery unit (50) may be freely turnably joined to the front portion of the frame (53), a wheel (80) and a rotational force conversion/transmission mechanism (90) for converting rotational force of the wheel (80) to vibration force to vibrate the recovery unit (50) may be provided at the rear portion of the frame (53), and the separation rod unit (95, 295) may be secured so that the rear end thereof comes into contact with a mesh member front portion (116*a*) of the recovery unit (50).

In connection with the rotation of the wheels, the recovery unit front portion is vertically moved around the recovery unit front end, so that the separation rod unit is vertically swung around the rod-shaped scraper. Accordingly, the lumps of sand scarped by the rod-shaped scraper can be efficiently pulverized and the working efficiency can be enhanced with keeping the amount of sand entering the recovery unit to a proper amount.

Effect of the Invention

According to the present invention, a separation rod unit comprising the plural longitudinal members and the lateral member for joining the rear ends of the respective longitudinal members is provided, and at least one separation rod unit is secured to the separator so as to be freely turnable in the up-and-down direction and bridged between the separator and the upper surface of the mesh member of the recovery unit. Therefore, the longitudinal members bounce heavy stones and garbage dropping into the gap between the rod-shaped scraper and the mesh member out of garbage, stones and sand scraped by the rod-shaped scraper to guide the heavy stones and garbage to the garbage recovery unit, and is also turned in the up-and-down direction to stir the flow of the scraped sand and pulverize the lumps of sand. The lateral member is mounted on the slope portion at the front portion of the mesh member, and serves as a projection traversing the front slope portion of the mesh member.

Accordingly, heavy stones and garbage such as large stones and plastic bottles containing liquid which drop into the gap between the rod-shaped scraper and the mesh member because they are heavy can be gathered in the garbage recovery unit. Furthermore, even when a large lump of sand is scraped by the rod-shaped scraper, the lump of sand can be divided and pulverized by the longitudinal members, so that the working efficiency can be enhanced with keeping the amount of sand entering the recovery unit to a proper amount. Furthermore, garbage gathered in the garbage recovery unit can be prevented from flowing back and dropping due to vibration.

MODES FOR CARRYING OUT THE INVENTION

First Embodiment

An embodiment of the present invention will be described hereunder with reference to the drawings. In the description, the front-and-rear, right-and-left and up-and-down directions are the same as those defined for a vehicle body if otherwise described.

Figure 1:
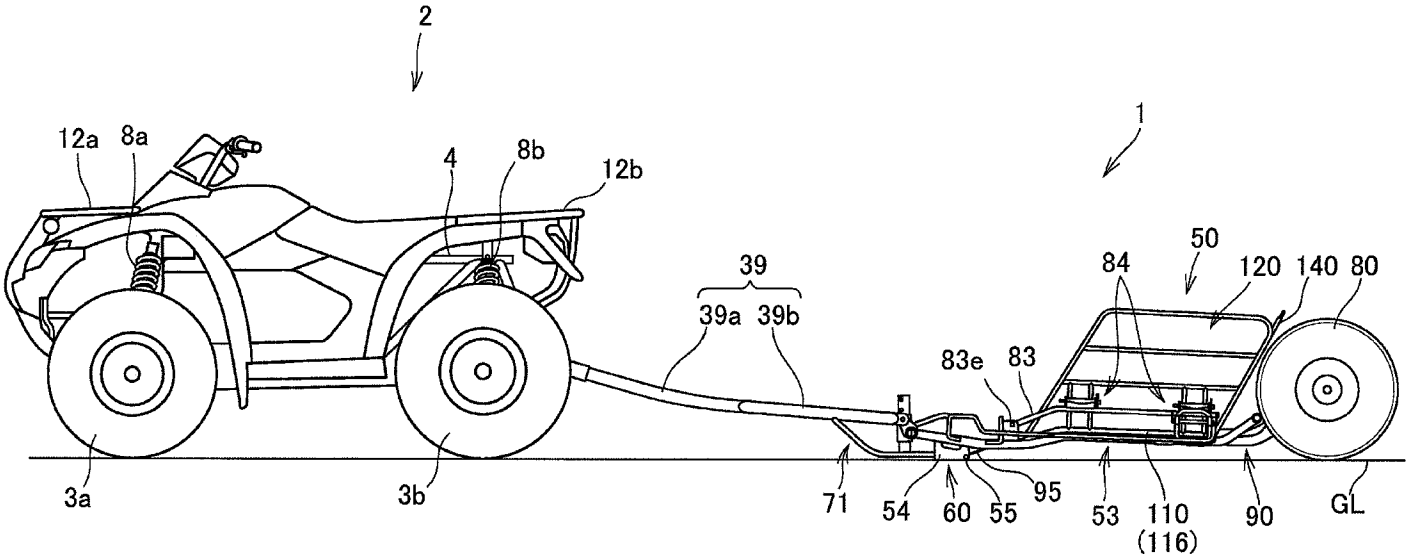
FIG. 1 is a left side view showing a vehicle towing state of a beach cleaner according to a first embodiment of the present invention.

FIG. 1 is a left side view of a towing state of a beach cleaner 1 according to the embodiment. The beach cleaner 1 is constructed as a towing type so that it can be towed by a vehicle 2. The vehicle 2 is a compact vehicle suitable for running on the sand of a seaside resort or the like, and has right and left front wheels 3*a* and rear wheels 3*b* as relatively large diameter low-pressure balloon tires at the front and rear sides of the vehicle body which is designed to be small in size and light in weight. The vehicle 2 is configured as a so-called ATV (All Terrain Vehicle) which secures a large minimum ground clearance to mainly enhance the running performance on uneven ground. The vehicle body frame of the vehicle 2 forms a box structure long in the front-and-rear direction at the center portion in the vehicle width direction, and an engine (not shown) as a power-generating machine of the vehicle 2 is mounted substantially at the center portion of the vehicle body frame. The engine (not shown) is a water-cooling type single cylinder engine, for example, and outputs the rotational driving force of a crankshaft to a front-and-rear propeller shaft through a gear engagement type transmission. The rotational driving force output to the front-and-rear propeller shaft is output to each of the front wheel 3*a* and the rear wheel 3 through a front-and-rear decelerating device (not shown).

Here, the vehicle 2 is a so-called semi-automatic vehicle in which the gear ratio of the transmission can be changed by electric operation. For example, the gear ratio can be changed through a centrifugal clutch, not by performing a clutch operation, but by merely operating a change button or the like. The vehicle 2 as described above more suitably runs under a larger running load or at a constant speed as compared with a vehicle having a belt type transmission. The vehicle 2 is not limited to the semi-automatic vehicle, but it may be an automatic transmission vehicle in which the change of the gear ratio is automated.

The right and left front wheels 3*a* are suspended from the front portion of the vehicle body frame through an independent suspension type front suspension 8*a*, and the right and left rear wheels 3*bb* are suspended from the rear portion of the vehicle body 4 through a swing arm type rear suspension 8*b*, for example. A trailer hitch (not shown) for traction is provided to the rear end portion of the swing arm of the rear suspension 8*b*, and the beach cleaner 1 is connected to the trailer hitch. In FIG. 1, reference numeral 12*a* represents a front carrier supported at the front portion of the vehicle body frame, and reference numeral 12*b* represents a rear carrier supported at the rear portion of the vehicle body frame.

Figure 2:
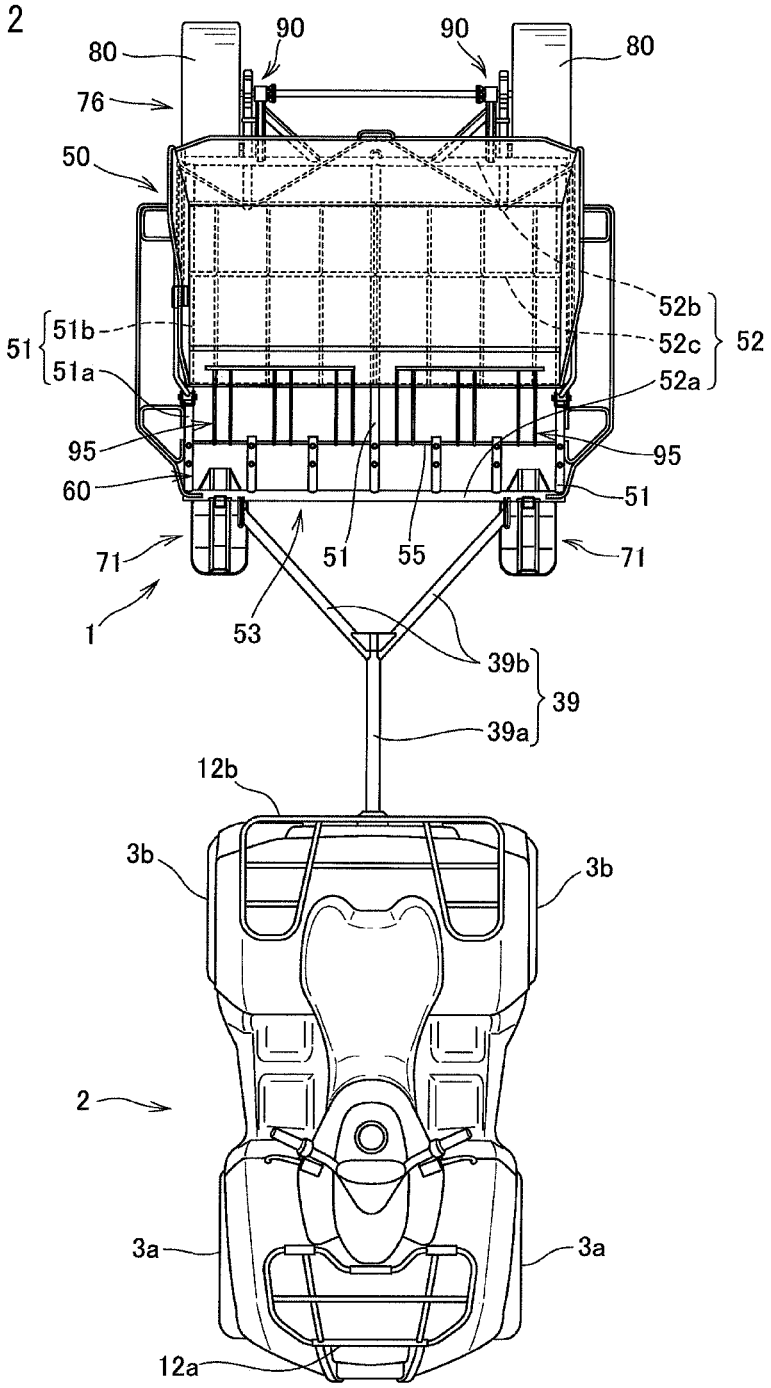
FIG. 2 is a top view of the vehicle towing state of the beach cleaner.

As shown in FIG. 2, the beach cleaner 1 has a frame 53 formed of plural (for example, three) longitudinal members 51 extending along the vehicle running direction and lateral members 52, that is, a front lateral member 52*a*, a rear lateral member 52*b* and a middle lateral member 52 extending along the width direction (right-and-left direction) which is substantially perpendicular to the vehicle running direction. A separator 60 described later is provided to the front portion of the frame 53, and a garbage recovery unit 50 described later is provided to the rear portion of the frame 53.

Figure 3:
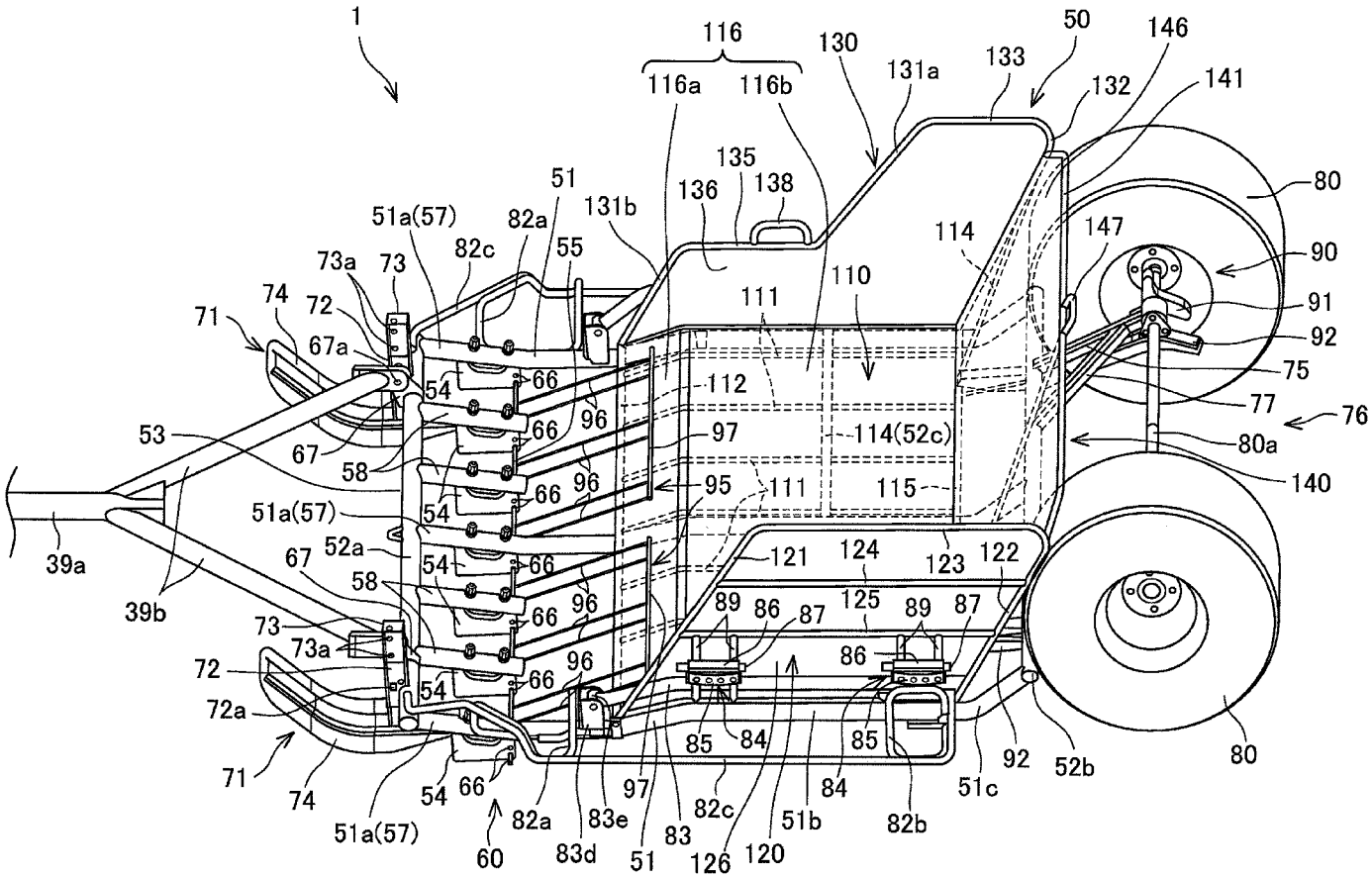
FIG. 3 is a perspective view showing the beach cleaner.
Figure 4:
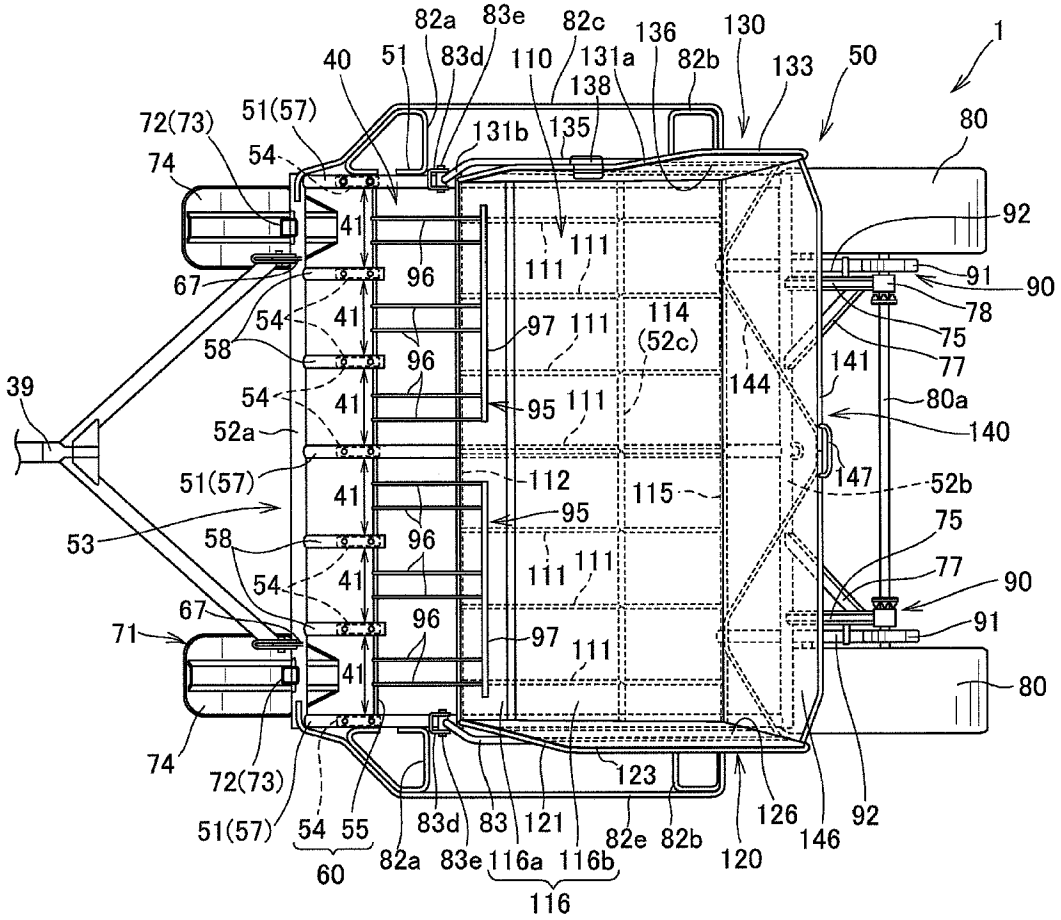
FIG. 4 is a top view showing the beach cleaner.

As shown in FIGS. 3 and 4, the longitudinal members 51 are arranged so that the rear portions 51*b* thereof are slightly upwardly displaced with respect to the front portions 51*a* thereof by arranging circular steel pipes along the front-and-rear direction and bending the middle portions thereof in the front-and-rear direction in a moderate crank-like shape in side view. Furthermore, with respect to the front portions 51*a* of the longitudinal members 51, the center portions thereof in the front-and-rear direction are moderately bent, so that the front half portions of the front portions 51*a* are inclined frontwards and upwards. In the following description, the front half portions of the front portions of the longitudinal members 51 are referred to as front slope portions 57. On the other hand, the rear end portions 51*c* of the longitudinal members 51 are provided to be curved upwards.

A plurality of longitudinal members 51 described above are arranged side by side in the right and left direction so as to be overlapped with one another in side view. The front ends of the longitudinal members 51 are joined to the front lateral member 52*a* formed of, for example, a circular steel pipe extending along the right-and-left direction so as to strike the front lateral member 52*a* from the back side thereof, and also the rear ends of the longitudinal members 51 are joined to the rear lateral member 52*b* formed of, for example a circular steel pipe extending along the right-and-left direction so as to strike the rear lateral member 52*b* from the lower side thereof. The frame 53 which mainly comprises the longitudinal members 51 and the lateral members 52 is designed to be substantially square in top view.

Plural (for example, two) scraper frames 58 are arranged side by side in the right and left direction between the longitudinal member 51 at the center in the right and left direction and each of the longitudinal members 51 at both the sides in the right and left direction so as to be overlapped with the front slope portions 57 in side view. The scraper frame 58 is formed of a circular steel pipe (may be formed of a square steel pipe), for example. The front end of the scraper frame 58 is joined to the front lateral member 52*a* so as to strike the front lateral member 52*a* from the back side thereof, and the rear end thereof serves as a free end which is not joined to any member.

A separator 60 for scraping stones and garbage (drink containers, wastepaper, tobacco-ashes, etc.) while separating the stones and the garbage from sand during running of the beach cleaner 1 is provided at the lower portion of the front portion of the frame 53. The separator 60 has support plates 54 arranged at equal intervals in the right and left direction and a scraper 55 which is secured to the respective support plates 54 so as to penetrate through the support plates 54.

The support plate 54 is a plate-like member which is detachably secured to the rear portion of the front slope portion 57 of the longitudinal member 51 and the rear portion of each scraper frame 58. The support plate 54 is secured through a bracket (not shown) to the lower outer surface of the front slope portion 57 or the scraper frame 58 so that the surface of the plate is substantially vertical to the ground surface and along the running direction.

Plural scraper support holes 66 are formed at the rear end portion of the support plate 54, and the scraper 55 is inserted through and supported in the respective scraper support holes 66. The scraper 55 is designed like a rod having a circular section and extending along the right-and-left direction, and supported by the respective support plates 54 while penetrate through the scraper support holes 66 over the respective support plates 54. Both the end portions of the scraper 55 are subjected to retaining by inserting predetermined fitting pins to both the end portions to prevent the scraper 55 from falling out from the support plates 54. The cross-sectional shape of the scraper 55 is not limited to a circular shape, but it may be a semi-circular shape having an upper surface inclined frontward and downward or the like. Two scrapers 55 may be provided, or the scrapers may be arranged vertically or obliquely.

Each support plate 54 and the scraper 55 are designed to submerge into the sand by a proper amount. In connection with running of the beach cleaner 1, each support plate 54 breaks the sand softly to pulverizes lumps of sand, and scrapes sand, stones and garbage to rectify them, and the scraper 55 scrapes up the sand, the stones and the garbage to the upper rear side, whereby the thus-scraped sand, stones and garbage are put into the garbage recovery unit 50 at the rear portion of the frame 53.

Towed portions 67 to be towed by the vehicle 2 are provided to the front portion of the frame 53. The towed portions 67 are designed as plate members of large thickness which are joined to two places of the front surface of the front lateral member 52*a* in the right-and-left direction and extend in the front-and-rear direction, and joint holes 67*a* are formed in the towed portions 67 to connect a towing rod 39 to the towed portions 67. The towing rod 39 serves to connect the vehicle 2 and the beach cleaner 1 with each other, and it has one front portion 39*a* and bifurcated portions 39*b*. The front end of the front portion 39*a* of the towing rod 39 is joined to a trailer hitch (not shown), and the rear end of the rear portion 39*b* is joined to joint holes 67*a* of the towed portions 67.

In place of the towing rod 39, one end of a chain (not shown) may be joined to the trailer hitch (not shown) while the other end thereof is joined to the joint hole 67*a* of the towed portion 67, whereby the vehicle 2 and the beach cleaner 1 are joined to each other.

Furthermore, front ski support pipes 72 for supporting front ski legs 71 are provided in front of the scraper frames 58 at the outermost sides in the right-and-left direction of the frame 53, for example. The front ski support pipe 72 is formed of a square steel pipe which is joined to a cut-out formed in the front lateral member 52*a* and extends in the up-and-down direction, and a leg member 73 formed of a square steel pipe in the front ski leg 71 can be inserted and supported in the front ski support pipe 72. The front ski leg 71 serves to set the ground height (the height from the surface of the sand) of the front portion of the beach cleaner 1 to a predetermined height and enhance the sliding performance of the beach cleaner 1 on the sand, and it is formed by erecting a leg member 73 on the front ski plate (ski member) 74 which has a predetermined width and is curved frontwards and upwards at the front portion thereof.

A right-and-left penetration hole 72*a* is formed in the front ski support pipe 72, and plural (for example, four) right-and-left penetration holes 73*a* adaptable to the right-and-left penetration hole 72*a* are vertically formed in the leg member 73, and any one of the right-and-left penetration holes 73*a* is overlapped with the right-and-left penetration hole 72*a* of the front ski support pipe 72, and a predetermined fitting pin or the like is inserted through these right-and-left penetration holes, whereby the ground height of the front portion of the frame 53 with respect to the front ski leg 71 is determined and thus the ground height of the front portion of the beach cleaner 1 is set to a predetermined height. That is, by inserting the fitting pin or the like into any right-and-left penetration hole 73*a* of the leg member 73, the ground height of the front portion of the beach cleaner 1 can be adjusted, whereby the submerging amount of each support plate 54 and the scraper 55 into the sand can be adjusted.

Rear legs 76 are supported at both the sides of the rear portion of the rear lateral member 52*b*. The rear leg 76 comprises extension frames 75 extending rearwards from both the sides of the rear portion of the rear lateral member 52*b*, rear leg reinforcing frames 77 for reinforcing the extension frames, and an axle 80*a* which is pivotally supported at the rear end portions of the extension frames 75 so as to be freely rotatable, and wheels 80*a* joined to both the right and left sides of the axle 80*a*. The rear leg 76 serves to set the ground height (the height from the sand surface) of the rear portion of the beach cleaner 1 to a predetermined height.

Front lift arm brackets 82*a* and rear lift arm brackets 82*b* are provided at the right and left outsides of the front and rear sides of the frame 53 respectively, and lift arms 82*c* for supporting the beach cleaner 1 when the beach cleaner 1 is lifted up are joined to these lift arm brackets.

A pair of right and left sub frames 83 extending over the front-and-rear direction of the garbage recovery unit 50 are joined to the right and left longitudinal members 51 so as to be freely turnable in the up-and-down direction. Sub frame brackets 83*d* are secured to the longitudinal members 51 at the front position of the garbage recovery unit 50. The sub frame 83 has a turning shaft 83*e* extending along the right-and-left direction at the front end thereof, and the turning shaft 83*e* is supported by the sub frame bracket 83*d* so as to be freely turnable. That is, the sub frame 83 is supported by the frame 53 so as to be vertically swingable around the turning shaft 83*e* as a pivot. The sub frame 83 is crooked in conformity with the shape of the longitudinal member 51 in side view, and configured so that the front portion thereof slightly slopes frontward and downward and the rear portion thereof is substantially horizontal.

A pair of hinge brackets 85 constituting parts of hinges 84 for supporting the left side portion of the garbage recovery unit 50 freely turnably are provided to the front and rear sides of the left-side sub frame 83. Hinge pipes 86 are arranged at the left side of the garbage recovery unit 50 in connection with the hinge brackets 85, and the hinge pipes 86 are pivotally supported by the hinge brackets 85 through hinge shafts 87 extending in the front-and-rear direction so as to be freely turnable. The hinge pipe 86 and the hinge shaft 87 are provided coaxially. By turning the garbage recovery unit 50 through the hinges 84 at the left side thereof, a recovery work for garbage collected in the garbage recovery unit 50 can be easily performed.

The garbage recovery unit 50 for collecting garbage scraped up by the separator 60 is provided at the rear side of the separator 60 of the frame 53. The garbage recovery unit 50 is configured in a box-like shape so as to be opened to the front and upper sides thereof. The garbage recovery unit 50 is constructed by securing a metal net having a predetermined mesh size or a plate to a frame-shaped frame which is mainly formed of steel pipes, for example. The garbage recovery unit 50 is configured to have substantially the same lateral width as the frame 53 in the right-and-left direction from a portion located slightly in front of the center of the frame 53 in the front-and-rear direction to a neighborhood of the rear end portion of the frame 53. The garbage recovery unit 50 has a bottom wall portion 110 having a laterally long rectangular shape in top view, a left side wall portion 120 which erects from the left side edge of the bottom wall portion 110 so as to be slightly obliquely tilted to the left outside, a right side wall portion 130 which erects from the right side edge of the bottom portion 110 so as to be slightly obliquely tilted to the right outside, and a rear wall portion 140 sloping frontward and downward at the rear edge of the bottom wall portion 110.

The bottom wall portion 110 is constructed by securing a bottom mesh member 116 such as a metal net or the like onto the plural (for example, nine) longitudinal frames 111 extending along the vehicle running direction and the lateral frames 112, 113, 115 extending along the width direction (right-and-left direction) which is substantially perpendicular to the longitudinal frames 111. The bottom wall portion 110 is bent in conformity with the shape of the longitudinal members 51 in side view.

In this embodiment, a part of the bottom wall portion 110 which is located in front of this bending position will be referred to as a bottom mesh member front portion 116*a*, and the other part of the bottom wall portion 110 which is located behind the bending position will be referred to as a bottom mesh member rear portion 116*b*. The bottom mesh member front portion 116*a* slops frontward and downward, and the bottom mesh member rear portion 116*b* slopes rearward and downward.

The left sidewall portion 120 has a front frame 121 sloping frontward and downward from the front end portion of the longitudinal frame 111, a rear frame 122 sloping frontward and downward from the rear end portion of the longitudinal frame 111, and has joint frames 123 to 124 through which the front frame 121 and the rear frame 122 are joined to each other, and is configured in a substantially parallelogram shape. The rear frame 122 is formed to be lower than the front frame 121, and the slope angle is set to 45°, for example. A left side plate 126 covering the left side wall portion 120 is secured at the inside of the front frame 121, the rear frame 122 and the joint frames 123 to 125 in the vehicle width direction.

Plural (for example, two pairs, that is, four) hinge frames 89 which are joined to the longitudinal frame 111 at one ends thereof and also joined to the joint frame 125 at the other ends thereof are provided to the front portion and rear portion of the left-sidewall portion 120. The hinge pipes 86 are integrally joined to the outer surfaces of the pair of front hinge frames 89 and the pair of rear hinge frames 89.

The right-sidewall portion 130 is configured to be shaped as if the front upper portion thereof is cut out with respect to the left-side wall portion 120, and as shown in FIG. 3, the right-side wall portion 130 has front frames 131*a* and 131*b* sloping frontward and downward, a rear frame 132 sloping frontward and downward from the rear end portion of the longitudinal frame 111, joint frames 133, 134 through which the front frame 131*a* and the rear frame 132 are joined to each other in the front-and-rear direction, and a joint frame 135 through which the front frame 131*b* and the rear frame 132 are joined to each other in the front-and-rear direction.

A right-side plate 136 covering the right-side wall portion 130 is secured at the inside of the front frames 131*a*, 131*b*, the rear frame 132 and the joint frames 133 to 135 in the vehicle width direction. A grip 138 projecting upwards is provided to the joint frame 135 in front of the front frame 131*a*. The grip 138 is designed to have an U-shape opened downward in side view so that the upper side portion thereof extends in the front-and-rear direction and the grip 138 is tilted to protrude slightly outwards with respect to the right-side wall portion 130.

Figure 5:
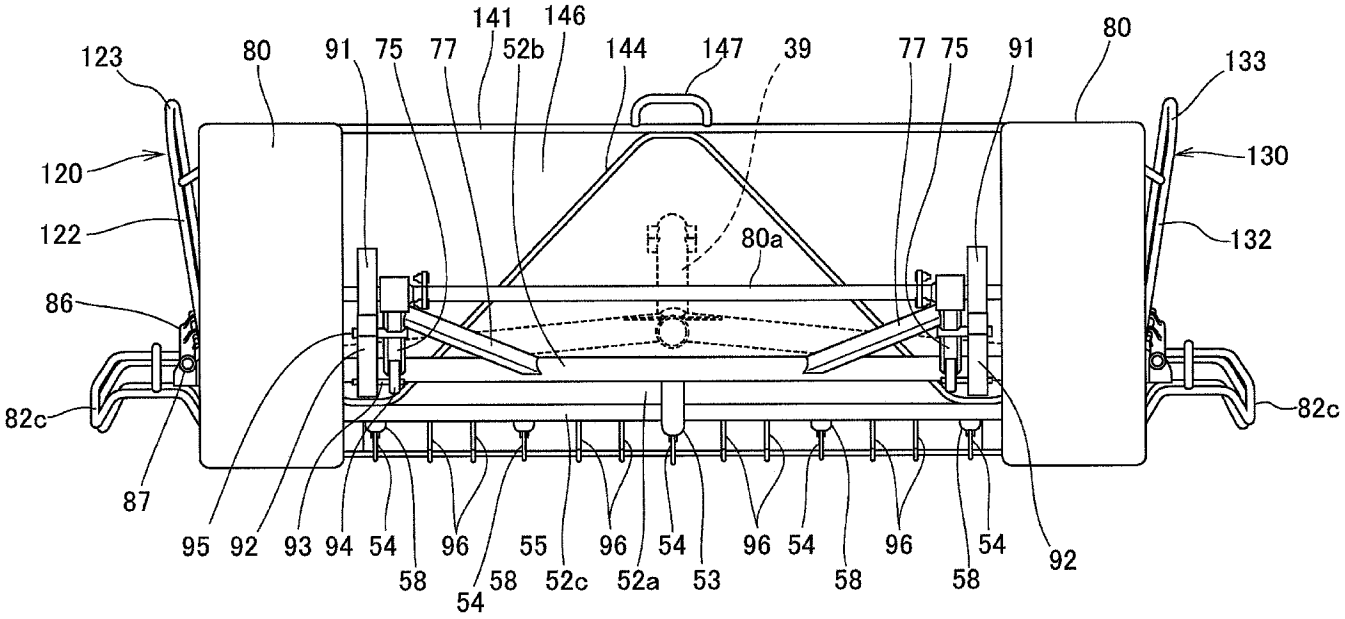
FIG. 5 is a back view of the beach cleaner.

As shown in FIGS. 1 and 3, the rear wall portion 140 is provided to be inclined frontward and downward, for example, at 45°, and has a joint frame 141 through which the upper portions of the right and left rear frames 122, 132 are joined to each other in the right and left direction. The rear wall portion 140 has a substantially W-shaped rear wall reinforcing frame 142 through which the rear frames 122, 132 of the left-side wall portion 120 and the right-side wall portion 130, the lateral frame 115 of the bottom wall portion 110 and the joint frame 141 are joined to one another. The joint frame 141 is formed substantially at the same height as the right and left joint frames 123, 133. A rear wall mesh member 146 such as a metal net or the like for receiving garbage, stones and sand scraped up into the garbage recovery unit 50 is secured at the front side of the joint frame 141, the rear wall reinforcing frame 144 and the lateral frame 115 (inside the box-shape). A grip 147 projecting upward is provided to the joint frame 141. As shown in FIG. 5, the grip 147 is designed in U-shape so as to be opened to the lower side thereof in back view and tilted so that the upper side portion thereof extends along the right and left direction and slightly protrudes outwards with respect to the rear wall portion 140.

In this embodiment, the rear wall mesh member 146 for receiving garbage, stones and sand scraped up by the separator 60 is inclined frontward and downward, and a sufficient gap is secured between the frame members for supporting the rear wall mesh member 146. Therefore, the garbage, the stones and the sand scraped up by the separator 60 can be received by the rear wall portion 140, and slid down along the slope of the rear wall portion 140, whereby the sand can screened. The garbage and the stones can be more efficiently separated from the sand by setting the slope angle of the rear wall portion 140 to about 45°.

In the garbage recovery unit 50, the left-side wall portion 120 is freely turnably joined and supported to the left-side sub frame 83 through the hinges 84 as described above. The garbage recovery unit 50 is turned through the hinges 84 so that the right side of the garbage recovery unit 50 is lifted up to set the bottom wall portion 110 to a substantially vertical erection state, whereby garbage collected in the garbage recovery unit 50 drops onto the left-side wall portion 120, and the garbage is discharged along the left-side wall portion 120 to the outside of the garbage recovery unit 120. The left-side plate 126 is secured to the left-side wall portion 120 of the garbage recovery unit 50, so that garbage can be smoothly discharged.

At this time, the grip 138 is provided to the right-side wall portion 130 of the garbage recovery unit 50, which facilitates the work of recovering garbage by turning the garbage recovery unit 50. Furthermore, the hinges 84 are arranged at the one short side (left side) of the laterally long garbage recovery unit 50 to secure the length from the turning shaft (hinge shaft 87) to the operating unit (the right-side grip 138) when the garbage recovery unit 50 is erected, whereby the turning operation of the garbage recovery unit 50 can be facilitated.

As shown in FIGS. 3 and 4, a pair of right and left rotational force conversion/transmission mechanisms 90 for converting the rotational driving force of the wheels 80 to vibration force and transmitting this vibration to the garbage recovery unit 50 are provided at the rear side of the garbage recovery unit 50.

Figure 7:
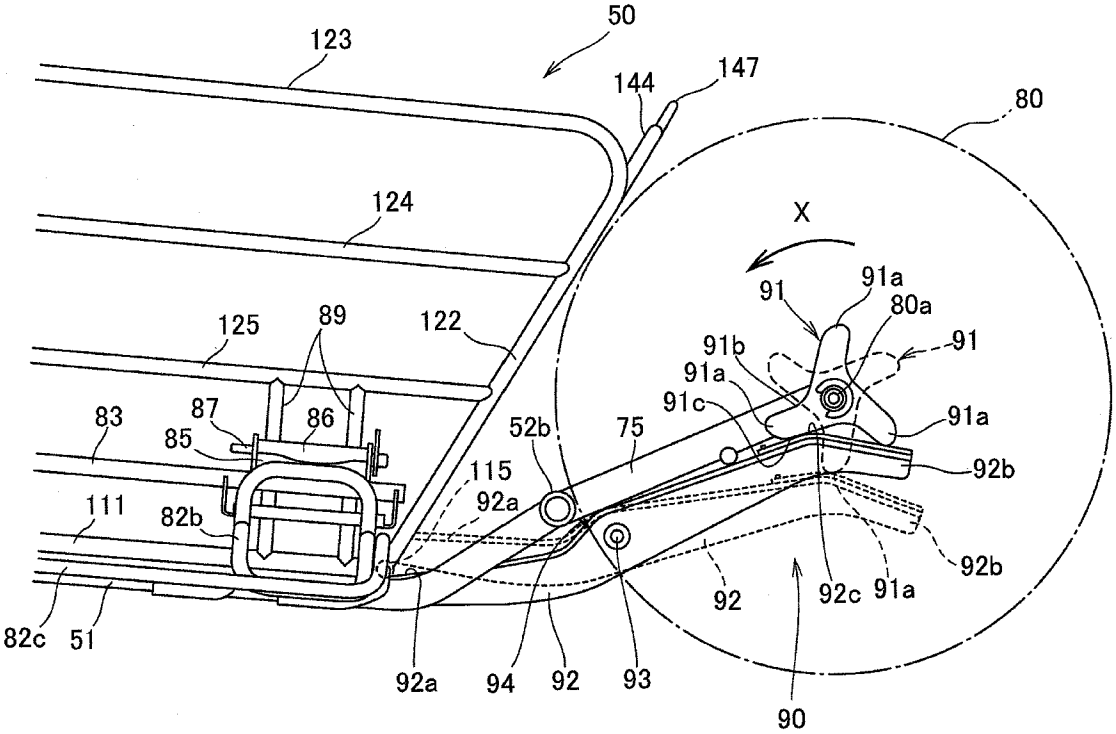
FIG. 7 is a partially abbreviated left side view showing the rear portion of the beach cleaner.

As shown in FIG. 7, each rotational force conversion/transmission mechanism 90 has a cam plate 91 fixed to the axle 80*a* of the wheel 80, a cam lever support portion 94 which is fixed to an extension frame 75 and has a support shaft 93, and a cam lever 92 which is pivotally supported by the cam lever support portion 94. The cam plate 91 has three cam mountain-shaped portions 91*a*, and rotates integrally with the wheel 80 in the direction of an arrow X. The cam plate 91 is configured so that the cam mountain-shaped portions 91*a* thereof serve as peaks, the rear edge portions 91*b* thereof are greatly constricted and the front edge portions 91*c* thereof are smoothly arcuate.

The cam lever 92 comes into contact with the cam plate 91. The center portion of the cam lever 92 is freely swingably supported through the support shaft 93 with respect to the extension frame 75. One end 92*a* of the cam lever 92 extends to the front side of the beach cleaner 1 below the rear lateral member 52*b* and further extends to the lower side of the lateral frame 115 (or the sub frame 83) of the garbage recovery unit 50, and the other end 92*b* of the cam lever 92 comes into contact with the cam plate 91. The upper surface of the other end 92*b* of the cam lever 92 has an upwardly convex crooked portion 92*c*, and the crooked portion 92*c* and the portion behind the crooked portion 92*c* come into contact with the downwardly facing surface portion of the cam plate 91. The stroke amount in the up-and-down direction of the one end 92*a* of the cam lever 92 is set in conformity with the slope angle of the bottom mesh member rear portion 116*b*. That is, the bottom mesh member rear portion 116*b* is set to be sloped rearward and downward at all times in order to prevent backflow of garbage or stones when the garbage recovery unit 50 is vertically swung by the operation of the cam lever 92.

As shown in FIGS. 3 and 4, plural (for example, two) separation rod members 95 are provided between the scraper 55 and the bottom mesh member 116 of the garbage recovery unit 50 so as to be filled in the gap between them. The separation rod member 95 has plural (for example, six) rod-like longitudinal members 96, and a rod-like lateral member 97 for joining the rear ends 96*b* of the respective longitudinal member 96 to one another.

Figure 6:
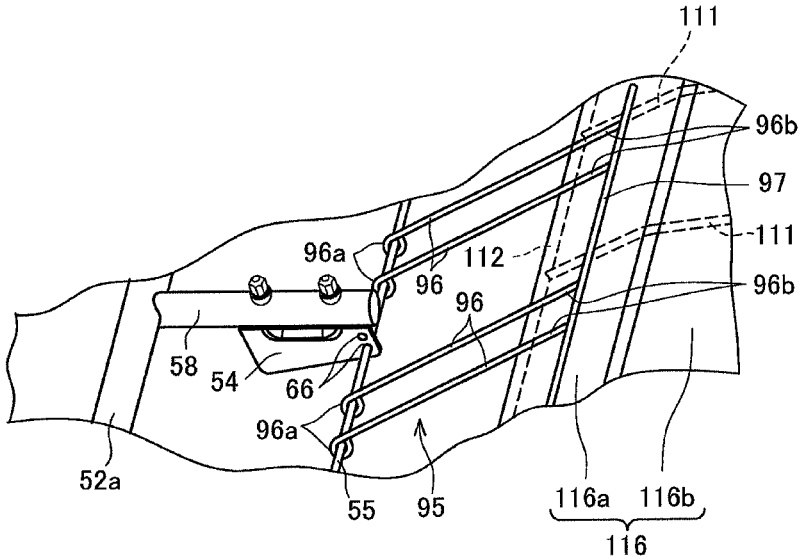
FIG. 6 is an enlarged perspective view showing the vicinity of a scraper of the beach cleaner.

The separation rod members 95 are secured to the separator 60 so as to be turnable in the up-and-down direction, and are provided so as to be bridged between the separator 60 and the upper surface of the bottom mesh member 116 of the garbage recovery unit 50. That is, as shown in FIG. 6, the front ends 96*a* of the longitudinal members 96 of the separation rod members 95 are designed to be crooked like a ring and wound around the scraper 55, whereby the front ends 96*a* are freely turnably secured to the scraper 55. The turning locus of each longitudinal member 96 is along a plane which is substantially parallel to the support plate 54. The rear ends 96*b* of the longitudinal members 96 are designed to extend to the bottom mesh member front portion 116*a* of the garbage recovery unit 50, and joined to the lateral members 97.

The rear portions of the longitudinal members 96 come into contact with the upper surface of the front end of the bottom mesh member 116. When the garbage recovery unit 50 is vertically turnable around the turning shafts 83*e* of the sub frames 83 as pivots, the front end of the bottom mesh member 116 vertically turns, so that the longitudinal members 96 vertically turns around the scraper 55. That is, the separation rod members 95 vertically turns in connection with the vertical turning movement of the garbage recovery unit 50.

The longitudinal members 96 bounce heavy stones and garbage dropping into the gap 40 between the scraper 55 and the bottom mesh member 116 out of garbage, stones and sand scraped up by the scraper 55, and guide the bounced stones and garbage to the garbage recovery unit 50. Accordingly, stones and garbage which drop into the gap 40 because they are heavy in weight can be collected in the garbage recovery unit 50. Furthermore, the vertically turning movement of the longitudinal members 96 stirs the flow of the scraped garbage, stones and sand, whereby lumps of sand contained in this flow can be pulverized. Furthermore, the longitudinal members 96 rectify the flow of the sand, stones and garbage scraped up by the scraper 55 so as to make the scraped sand, stones and garbage smoothly enter the garbage recovery unit 50. Accordingly, garbage and stones can be suppressed from jumping in directions different from the direction to the garbage recovery unit 50, and also it is possible to collect garbage such as small vinyl pieces, etc. which are difficult to be collected because the flow direction of the garbage cannot be stabilized by merely scraping the garbage with the scraper 55.

Furthermore, the lateral members 97 are located substantially at the center in the front-and-rear direction of the bottom mesh member front portion 116*a*, and serve as projection traversing the bottom mesh member front portion 97. Accordingly, garbage and stores collected in the garbage recovery unit 50 can be prevented from flowing back and dropping due to vibration.

The separation rod units 95 can be turned around the scraper 55 and tilted to the front side. Therefore, when the garbage recovery unit 50 is turned around the hinge shafts 87 of the hinges 84 provided at the left side of the garbage recovery unit 50, the separation rod units 95 do not disturb the turning of the garbage recovery unit 50.

Openings 99 formed among the longitudinal members 96 and the lateral members 97 of the separation rod members 95 are formed to be larger than the openings (the meshes of the net) of the bottom mesh member 116 and the rear wall mesh members 146 of the garbage recovery unit 50. Accordingly, the sand scraped up onto the separation rod units 95 can be efficiently dropped, whereby the amount of sand entering the garbage recovery unit 50 can be kept to a proper amount.

Furthermore, at least one (for example, two) longitudinal member 96 is secured between adjacent support plates 54, and arranged so that the interval 41 between the adjacent support plates 54 are equally sectioned (by three, for example). Accordingly, unevenness in size of garbage and stones to be recovered and unevenness in pulverization degree of lumps of sand can be prevented from occurring between the respective support plates.

The operation of the beach cleaner 1 will be described.

The beach cleaner 1 is moved on the sand beach while towed by the vehicle 2, and garbage and stones are scraped together with sand by the respective support plates 54 and the scraper 55 and collected in the garbage recovery unit 50 at the rear portion of the frame 53.

At this time, when the garbage and the stones scraped up together with the sand by the support plates 54 and the scraper 55 impinge against the rear wall portion 140 which is sloped frontward and downward, the garbage, the stones and the sand are slipped down on the rear wall mesh member 146 while the sand is screened from the mesh member 145.

The garbage recovery unit 50 is vertically vibrated by the rotational force conversion/transmission mechanism 90 while the beach cleaner 1 runs. Accordingly, the sand collected in the garbage recovery unit 50 is screened out from the garbage recovery unit 50.

When the front portion of the garbage recovery unit 50 is vertically moved in connection with the rotation of the wheels 80 while the beach cleaner 1 runs, the separation rod members 95 are vertically swung around the scraper 55. Accordingly, the lumps of sand scraped up by the scraper 55 are efficiently pulverized, and drop into the openings 99 of the separation rod members 95.

When the other end 92*b* of the cam lever 92 comes into contact with the two cam mountain-shaped portions 91*a* of the cam plate 91 at the crooked portion 92*c* and behind the crooked portion 92*c* as indicated by a solid line of FIG. 7, the other end 92*b* of the cam lever 92 is located at the highest position, and the one end 92*a* of the cam lever 92 is located at the lowest position.

When the wheels 80 rotate in the direction of the arrow X, the cam plates 91 rotate integrally with the wheels 80 in the same direction as the wheels 80, and one cam mountain-shaped portion 91 is set to come into contact with the crooked portion 92*c* of the other end 92*b* of the cam lever 92, whereby the other ends 92*b* of the cam levers 92 are gradually downwardly pushed according to the smooth cam profile of the front edge portion 91*c*.

Accordingly, the cam levers 92 are turned around the support shafts 93 in the opposite direction to the wheels 80, and the one ends 92*a* of the cam levers 92 push up the lateral frame 115 (or the sub frames 83).

When the cam mountain-like portion 91*a* of the cam plate 91 faces just down, the one end 92*a* of the cam lever 92 pushes up the lateral frame 115 of the garbage recovery unit 50 to the uppermost position.

At this time, the bottom mesh member front portion 116*a* of the garbage recovery unit 50 is slightly upwardly moved, whereby the lateral members 97 of the rear ends of the separation rod members 95 are pushed up.

When the wheels 80 further rotate, the cam mountain-shaped portions 91*a* of the cam plates 91 move to the rear sides of the crooked portions 92*c* of the cam levers 92. At this time, the cam levers 92 are upwardly convex at the crooked portions 92*c* thereof, and the rear edge portions 91*b* of the cam plates 91 are shaped to be greatly constricted. Therefore, the cam levers 92 are released from the cam plates 91, and thus rapidly displaced from the position indicated by a chain line in FIG. 7 to the position indicated by the solid line in FIG. 7. That is, the one ends 92*a* of the cam levers 92 drop rapidly, and the garbage recovery unit is dropped to be in a position indicated by the solid line of FIG. 7 while bumped.

At this time, the bottom mesh member front portion 116*a* of the garbage recovery unit 50 also moves downwardly, and the rear ends of the separation rod units 95 also turn downwardly in connection with the downward movement of the bottom mesh member front portion 116*a*.

In this construction, the operation of pushing up the garbage recovery unit 50 and dropping the garbage recovery unit 50 so that the garbage recovery unit 50 is in a substantially horizontal position with being bumped is repeated three times every time the wheels 80 make a revolution. Furthermore, the separation rod units 93 are vertically turned three times in connection with the vertical movement of the garbage recovery unit 50.

That is, the rotational force conversion/transmission mechanism 90 converts the driving force of the wheel 80 to the driving force for vertically vibrating the garbage recovery unit 50 through the cam plate 91 and the cam lever 92 and transmits the driving force to the garbage recovery unit 50. Therefore, the rotational driving force of the wheels 80 can be remarkably efficiently converted to vibration with a simple mechanism. Every time the wheels 80 make a revolution, the garbage recovery unit 50 is dropped to be in a substantially horizontal position over three times while being bumped. Therefore, the sand can be efficiently screened by the dropping impact.

In connection with the rotation of the wheels 80, the front portion of the garbage recovery unit 50 is turned in the up-and-down direction, and the separation rod units 95 are vertically swung around the scraper 55 in connection with the vertical movement of the garbage recovery front portion. Accordingly, the lumps of sand scraped by the scraper 55 can be efficiently pulverized, and the amount of sand entering the garbage recovery unit 50 can be kept to a predetermined amount.

As described above, according to this embodiment, the separation rod unit 95 comprising the plural longitudinal members 96 and the lateral member 97 for joining the rear ends 96*b* of the respective longitudinal members 96 is provided, and at least one separation rod unit 95 is secured to the separator 60 to be turnable in the up-and-down direction and bridged between the separator 60 and the upper surface of the mesh member of the garbage recovery unit 50. Therefore, the longitudinal members 96 bounce heavy stones and garbage which fall into the gap 40 between the scraper 55 and the bottom mesh member 116 out of garbage, stones and sand scraped by the scraper 55, and guide the heavy stones and garbage to the garbage recovery unit 50, and also the longitudinal members 96 are vertically turned to stir the flow of scraped sand and pulverize the lumps of sand. Furthermore, the lateral members 97 serves as projections which are mounted on the bottom mesh member front portion 116*a* so as to traverse the bottom mesh member front portion 116*a*.

Accordingly, large stones and garbage such as plastic bottles, etc. which fall into the gap 40 between the scraper 55 and the bottom mesh member 116 because they are heavy in weight can be recovered in the garbage recovery unit 50. Furthermore, even when large lumps of sand are scraped by the scraper 55, the lumps of sand can be divided or pulverized by the longitudinal members 96, and the amount of sand entering the garbage recovery unit 50 can be kept to a proper amount, thereby enhancing the working efficiency. Furthermore, garbage and stones recovered in the garbage recovery unit 50 can be prevented from flowing back and dropping due to vibration.

In this embodiment, the openings 99 formed among the longitudinal members 96 and the lateral member 97 of the separation rod unit 95 are formed to be larger than the meshes of the bottom mesh member 116 of the garbage recovery unit 50. Therefore, most of scraped sand can be sieved through the openings 99 of the separation rod units 95, so that the amount of sand entering the garbage recovery unit 50 can be kept to a proper amount.

Furthermore, in this embodiment, the separator 60 has the support plates 54 arranged in the lateral direction at equal intervals and the scraper 55 penetrating through the respective support plates 54, and the front ends 96*a* of the longitudinal members 96 of the separation rod members 95 are secured to the scraper 55 so as to be freely turned. Therefore, the flow of sand, stones and garbage scraped by the scraper 55 is rectified by the longitudinal members 96, and the stones, sand and garbage scraped by the rod-shaped scraper are enabled to smoothly enter the garbage recovery unit 50 along the longitudinal members 96, whereby the garbage and the stones can be efficiently gathered.

Furthermore, in this embodiment, the respective support plates 54 are provided to be substantially vertical to the ground surface and arranged along the running direction, and each longitudinal member 96 is provided to be freely turnable along a plane which is substantially parallel to each support plate 54. Therefore, the flow of sand, stones and garbage is rectified in the running direction by the support plates 54 and the longitudinal members 96, whereby the garbage and the stones can be prevented from jumping in directions different from the direction to the garbage recovery unit 50 and thus the garbage and the stones can be recovered more efficiently.

Furthermore, in this embodiment, one or more longitudinal members 96 of the separation rod unit 95 are secured between adjacent support plates, and arranged so as to section the gap between the adjacent support plates 54 at equal intervals. Therefore, occurrence of uneven recovery of garbage and uneven pulverization of lumps of sand in the gaps between the adjacent support plates 54 can be prevented.

Furthermore, in this embodiment, the front portion of the garbage recovery unit 50 is freely turnably secured to the frame 53, the wheels 80 and the rotational force conversion/transmission mechanism 90 for converting the rotational force of the wheels 80 to the vibration force to vibrate the garbage recovery unit 50 is provided to the rear portion of the frame 53, and the separation rod units 95 are secured so that the rear portions thereof come into contact with the bottom mesh member front portion 116*a*. Therefore, the front end of the garbage recovery unit 50 is vertically moved in connection with the rotation of the wheels 80, and the separation rod units 95 are vertically swung around the scraper 55 in connection with the vertical movement of the front end of the garbage recovery unit 50. Accordingly, the lumps of sand scraped by the scraper 55 can be more efficiently pulverized, and the working efficiency can be enhanced with keeping the amount of sand entering the garbage recovery unit 50 to a proper amount.

Second Embodiment

In the first embodiment, the separation rod units 95 are joined to the separator 60 so as to be freely turnable. Therefore, the front ends 96*a* of the longitudinal members 96 of the separation rod units 95 are crooked so as to be wound around the scraper 55, and the scraper 55 is configured to penetrate through the front ends 96*a*.

According to this embodiment, in order to prevent the separation rod units from being displaced in the right-and-left direction, a collar having a predetermined length in the axial direction thereof is provided to the front end of the longitudinal member of the separation rod unit, and the separation rod units are secured to the separator so that the rod-like scraper penetrates through the collars.

Figure 8:
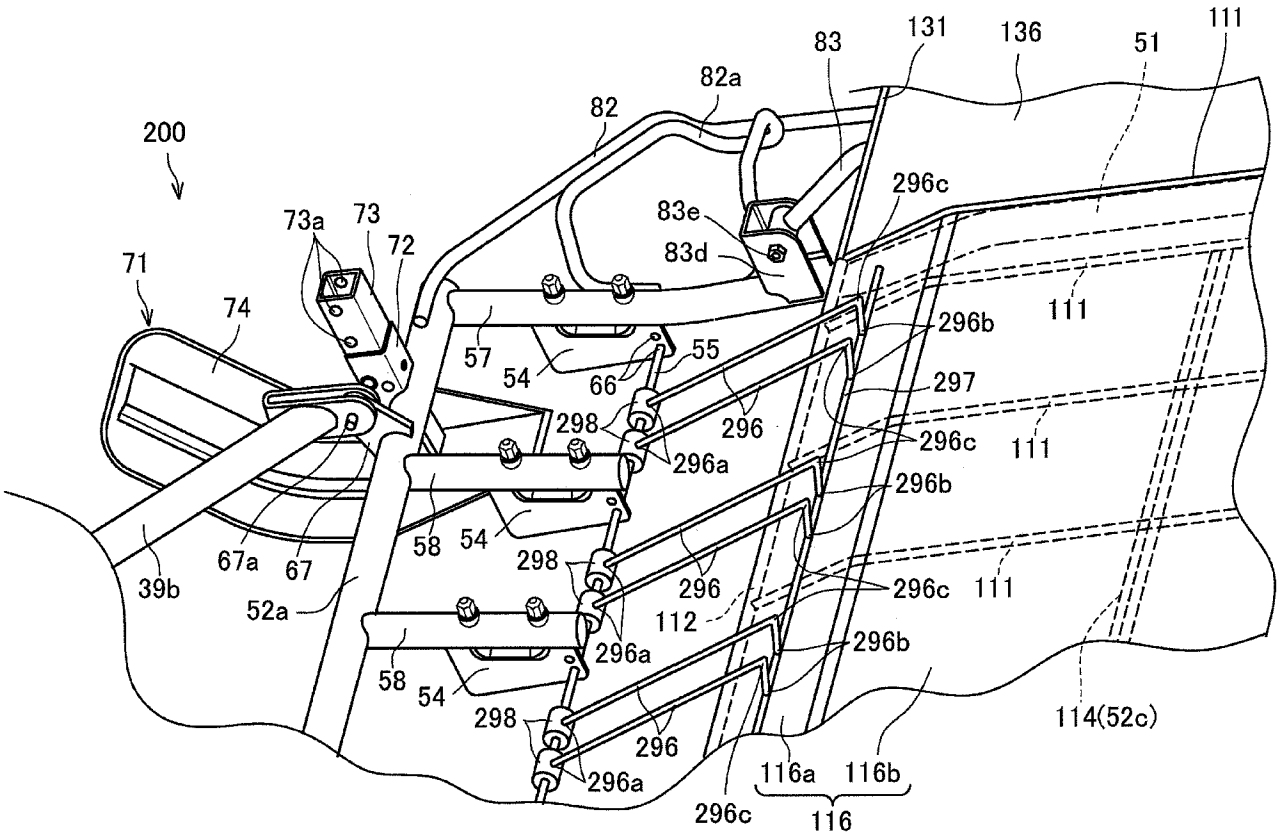
FIG. 8 is an enlarged perspective view showing the vicinity of the scraper of a beach cleaner according to a second embodiment of the present invention.

FIG. 8 is a perspective view containing an enlarged view showing the neighborhood of the scraper 55 of a beach cleaner 200 according to the second embodiment. In FIG. 8, the same parts as the first embodiment are represented by the same reference numerals, and the description thereof is omitted.

A separation rod unit 295 has plural (for example, six) longitudinal members 296, and a lateral member 297 for joining the rear ends 296*b* of the respective longitudinal members 296.

A collar 298 having a predetermined length in the axial direction thereof is secured to the front end 296*a* of each longitudinal member 296, and the scraper 55 penetrates through the collars 298, whereby the separation rod unit 295 is freely turnably secured to the separator 60. Accordingly, for example when a large stone drops to the gap between the longitudinal member 51 of the frame 53 and the longitudinal member 96 of the separation rod unit 95 and thus force is applied to some longitudinal unit 96 of the separation rod unit 95 in the right-and-left direction, both the end portions in the right-and-left direction of each collar 298 bite the scraper 55 and the collars 298 do not move in the right-and-left direction, so that the separation rod unit 95 is prevented from being displaced in the right-and-left direction.

Each longitudinal members 296 of the separation rod unit 295 has a crooked portion 296*c* at the rear portion thereof. The longitudinal member 296 extends from the front end 296*a* thereof joined to the collar 298 while sloping rearward and upward in side view, crooks at the crooked portion 296*c* thereof and extends substantially downward, and the rear end 296*b* of the longitudinal member 296 is joined to the upper surface of the lateral member 297. Accordingly, the portion extending from the crooked portion 296*c* to the rear end 296*b* of each longitudinal member 296 serves as a projection which protrudes from the upper surface of the lateral member 297 serving as a projection traversing the bottom mesh member front portion 116*a* in front view. Therefore, garbage gathered into the garbage recovery unit 50 can be surely prevented from flowing back and dropping due to vibration.

In this embodiment, each collar 298 having a predetermined width is joined to the front end 296*a* of each longitudinal member 296, and the scraper 55 penetrates through the collars 298, whereby the separation rod unit 295 is freely turnably joined to the separator 60. Therefore, even when force in the right-and-left direction is applied to the separation rod unit 295, the end portion of the collar 298 bites the scraper 55, thereby regulating the displacement in the right-and-left direction of the separation rod unit 95. Accordingly, uneven recovery of garbage and uneven pulverization of lumps of sand can be surely prevented while the interval between the support plate 54 and the longitudinal member 296 is kept to be fixed.

Third Embodiment

According to the first embodiment, in order to efficiently pulverize the lumps of sand scraped by the scraper 55 and efficiently screen sand entering the garbage recovery unit 50, the front portion of the garbage recovery unit 50 is freely turnably secured to the longitudinal members 51, and the wheels 80 and the rotational force conversion/transmission mechanism 90 for converting the rotational force of the wheel 80 to the vibration force to vibrate the garbage recovery unit 50 are provided to the rear portion of the frame 53. The separation rod unit 95 is secured so that the rear end thereof comes into contact with the bottom mesh member front portion 116*a* of the garbage recovery unit 50.

Figure 9:
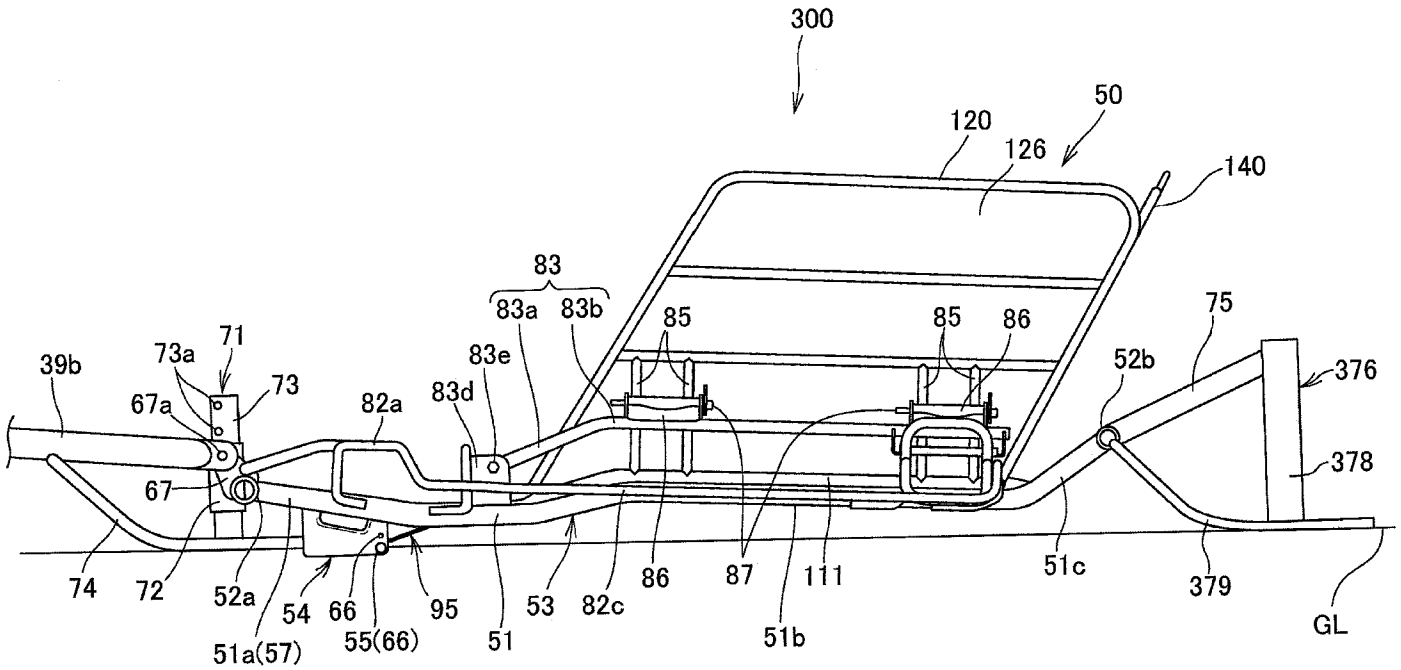
FIG. 9 is a left side view showing a beach cleaner according to a third embodiment of the present invention.

In this embodiment, in order to reduce the number of parts and simplify the construction, a rear ski leg 376 is secured to the rear portion of the extension frame 75. As shown in FIG. 9, the rear ski leg 376 is used to set the ground height (the height from the sand surface) of the rear portion of the beach cleaner 1 to a predetermined height and also enhance the sliding performance of the beach cleaner 1 on the sand, and it is constructed by erecting a leg member 378 on a rear ski plate (ski member) 379 which is sloped frontward and upward at the front portion thereof and has a predetermined width.

The above embodiments are examples of the present invention, and they may be arbitrarily modified within the subject matter of the present invention.

For example, in the above embodiments, the separation rod unit 95 is secured so that the rear end thereof comes into contact with the bottom mesh member front portion 116*a* of the garbage recovery unit 50. However, the position of the rear end of the separation rod unit 95 is not limited to the above embodiments, and the separation rod unit 95 may be secured so that the rear end thereof comes into contact with the bottom mesh member rear portion 116*b*. In this case, the bottom mesh member rear portion 116*b* of the garbage recovery unit 50 is designed to slope rearward and downward at all times, and garbage and stones can be more surely prevented from flowing back because the lateral member 97 as the rear end of the separation rod unit 95 serves as a projection traversing the bottom mesh member rear portion 116*b*.

Furthermore, the longitudinal members 96 of the separation rod units 95 are configured to extend in the front-and-rear direction in top view. However, the extension direction of the longitudinal members 96 is not limited to this direction, and it may be an oblique direction in top view. Furthermore, in the above embodiments, the separation rod unit 95 comprises the longitudinal members 96 and the lateral member 97 which joins the rear ends 96*b* of the longitudinal members 96. However, the separation rod unit 95 may be constructed as a mesh member such as a metal net or the like. In the above embodiments, the rotational force conversion/transmission mechanism 90 has the cam plate 91 having the three cam mountain-shaped portions 91*a*. However, the shape of the cam plate 91 is not limited to this shape.

DESCRIPTION OF REFERENCE NUMERALS

1, 200, 300 beach cleaner
2 vehicle (tow vehicle)
41 interval (gap)
50 garbage recovery unit (recovery unit)
51 longitudinal member
52 lateral member
53 frame
54 support plate
55 scraper (rod-shaped scraper)
60 separator
67 tow target portion
80 wheel
90 rotational force conversion/transmission mechanism
95, 295 separation rod unit
96, 296 longitudinal member
96*a*, 296*a* front end
96*b*, 296*b* rear end
97, 297 lateral member
99 opening
116 bottom mesh member (mesh member)
116*a* bottom mesh member front portion (mesh member front portion)
298 collar

The invention claimed is:

1. A beach cleaner having a frame (53) comprising a longitudinal member (51) and a lateral member (52), a towed portion (67) that is provided at a front portion of the frame (53) and configured to be towed by a tow vehicle, a separator (60) that is provided at a lower front portion of the frame (53) to separate and scrape garbage from sandy ground, and a recovery unit (50) that is provided to the frame (53) behind the separator (60) and collects the garbage scraped by the separator (60) onto a mesh member (116), characterized by further comprising at least one separation rod unit (95) having longitudinal members (96) and a lateral member (97) for joining rear ends (96*b*) of the longitudinal members (96), the separation rod unit (95) being provided to be bridged between the separator (60) and the upper surface of the mesh member (116) of the recovery unit (50) so that a front end of the separation rod unit (95) is secured to the separator (60) so as to be turnable in an up-and-down direction.

2. The beach cleaner according to claim 1, wherein openings (99) formed by the longitudinal members (96) and the lateral member (97) of the separation rod unit (95) are larger than meshes of the mesh member (116) of the recovery unit (50).

3. The beach cleaner according to claim 1, wherein the separator (60) has support plates (54) provided at equal intervals in a lateral direction and a rod-shaped scraper (55) penetrating through the support plates (54), and front ends (96*a*) of the longitudinal members (96) of the separation rod unit (95) are freely turnably secured to the rod-shaped scraper (55).

4. The beach cleaner according to claim 1, wherein at least one longitudinal member (96) of the separation rod unit (95) is secured and arranged between adjacent support plates (54) so as to section the gap (41) between the adjacent support plates (54) at equal intervals.

5. The beach cleaner according to claim 1, wherein a collar (298) having a predetermined length in an axial direction thereof is provided to the front end (96*a*, 296*a*) of each of the longitudinal members (96, 296) of the separation rod member (25, 295) so that the rod-shaped scraper (55) penetrates through the collar (298), thereby securing the separation rod unit (95, 295) to the separator (60).

6. The beach cleaner according to claim 1, wherein the recovery unit (50) is freely turnably joined to the front portion of the frame (53), a wheel (80) and a rotational force conversion/transmission mechanism (90) for converting rotational force of the wheel (80) to vibration force to vibrate the recovery unit (50) are provided at the rear portion of the frame (53), and the separation rod unit (95, 295) is secured so that the rear end thereof comes into contact with a mesh member front portion (116*a*) of the recovery unit (50).

7. The beach cleaner according to claim 2, wherein the separator (60) has support plates (54) provided at equal intervals in a lateral direction and a rod-shaped scraper (55) penetrating through the support plates (54), and front ends (96*a*) of the longitudinal members (96) of the separation rod unit (95) are freely turnably secured to the rod-shaped scraper (55).

8. The beach cleaner according claim 2, wherein at least one longitudinal member (96) of the separation rod unit (95) is secured and arranged between adjacent support plates (54) so as to section the gap (41) between the adjacent support plates (54) at equal intervals.

9. The beach cleaner according to claim 3, wherein at least one longitudinal member (96) of the separation rod unit (95) is secured and arranged between adjacent support plates (54) so as to section the gap (41) between the adjacent support plates (54) at equal intervals.

10. The beach cleaner according to claim 2, wherein a collar (298) having a predetermined length in an axial direction thereof is provided to the front end (96*a*, 296*a*) of each of the longitudinal members (96, 296) of the separation rod member (25, 295) so that the rod-shaped scraper (55) penetrates through the collar (298), thereby securing the separation rod unit (95, 295) to the separator (60).

11. The beach cleaner according to claim 3, wherein a collar (298) having a predetermined length in an axial direction thereof is provided to the front end (96*a*, 296*a*) of each of the longitudinal members (96, 296) of the separation rod member (25, 295) so that the rod-shaped scraper (55) penetrates through the collar (298), thereby securing the separation rod unit (95, 295) to the separator (60).

12. The beach cleaner according to claim 4, wherein a collar (298) having a predetermined length in an axial direction thereof is provided to the front end (96*a*, 296*a*) of each of the longitudinal members (96, 296) of the separation rod member (25, 295) so that the rod-shaped scraper (55) penetrates through the collar (298), thereby securing the separation rod unit (95, 295) to the separator (60).

13. The beach cleaner according to claim 2, wherein the recovery unit (50) is freely turnably joined to the front portion of the frame (53), a wheel (80) and a rotational force conversion/transmission mechanism (90) for converting rotational force of the wheel (80) to vibration force to vibrate the recovery unit (50) are provided at the rear portion of the frame (53), and the separation rod unit (95, 295) is secured so that the rear end thereof comes into contact with a mesh member front portion (116*a*) of the recovery unit (50).

14. The beach cleaner according to claim 3, wherein the recovery unit (50) is freely turnably joined to the front portion of the frame (53), a wheel (80) and a rotational force conversion/transmission mechanism (90) for converting rotational force of the wheel (80) to vibration force to vibrate the recovery unit (50) are provided at the rear portion of the frame (53), and the separation rod unit (95, 295) is secured so that the rear end thereof comes into contact with a mesh member front portion (116*a*) of the recovery unit (50).

15. The beach cleaner according to claim 4, wherein the recovery unit (50) is freely turnably joined to the front portion of the frame (53), a wheel (80) and a rotational force conversion/transmission mechanism (90) for converting rotational force of the wheel (80) to vibration force to vibrate the recovery unit (50) are provided at the rear portion of the frame (53), and the separation rod unit (95, 295) is secured so that the rear end thereof comes into contact with a mesh member front portion (116*a*) of the recovery unit (50).

16. The beach cleaner according to claim 5, wherein the recovery unit (50) is freely turnably joined to the front portion of the frame (53), a wheel (80) and a rotational force conversion/transmission mechanism (90) for converting rotational force of the wheel (80) to vibration force to vibrate the recovery unit (50) are provided at the rear portion of the frame (53), and the separation rod unit (95, 295) is secured so that the rear end thereof comes into contact with a mesh member front portion (116*a*) of the recovery unit (50).

* * * * *